US005183178A

United States Patent [19]

Flemming

[11] Patent Number: 5,183,178

[45] Date of Patent: Feb. 2, 1993

[54] BULK CONTAINERS

[76] Inventor: Elvin-Jensen Flemming, 4655 Woodgreen Dr., West Vancouver, Canada

[21] Appl. No.: 908,776

[22] Filed: Jul. 1, 1992

Related U.S. Application Data

[63] Continuation of Ser. No. 639,055, Jan. 9, 1991, abandoned.

[30] Foreign Application Priority Data

Sep. 24, 1990 [AU] Australia ..... PK2442

[51] Int. Cl.[5] ..... B65D 69/00

[52] U.S. Cl. ..... 220/650; 220/639; 206/582

[58] Field of Search ..... 220/639, 646, 647, 650, 220/676; 206/582; 52/514

[56] References Cited

U.S. PATENT DOCUMENTS

| | | | |
|---|---|---|---|
| 472,849 | 4/1892 | Behne | 220/639 |
| 744,991 | 11/1903 | Achterman | 220/650 |
| 3,317,080 | 5/1967 | Buttrick et al. | 220/650 |
| 4,094,430 | 6/1978 | Cavley | 220/646 |
| 4,370,842 | 2/1983 | Martin et al. | 52/51 X |
| 4,405,048 | 9/1983 | Peake | 206/582 |
| 4,406,107 | 9/1983 | Schoonbeck | 52/51 X |
| 4,820,564 | 4/1989 | Cologna et al. | 206/582 |
| 4,825,605 | 5/1989 | Weir | 52/51 X |
| 4,882,912 | 11/1989 | Fossey | 220/647 |
| 4,947,988 | 8/1990 | Schotz | 220/647 |

FOREIGN PATENT DOCUMENTS

| | | | |
|---|---|---|---|
| 735758 | 8/1955 | United Kingdom | 52/51 X |

*Primary Examiner*—Joseph Man-Fu Moy
*Attorney, Agent, or Firm*—Bell, Seltzer, Park & Gibson

[57] ABSTRACT

A moulded plastic bulk container of the kind used in storage of materials and is normally transported from location to location by a fork lift truck and comprises sidewalls and a base, with a recess or opening in its lower portion below the base for receiving the "tines" of a fork. Integral ribs are formed at the sloping inlet to the opening which is shaped so that the front ends of the tines can enter the recess is of greater height than the remainder of the recess.

14 Claims, 3 Drawing Sheets

BULK CONTAINERS

This application is a continuation of application Ser. No. 07/639,055, filed Jan. 9, 1991, now abandoned.

This invention relates to bulk containers.

The invention is concerned with a bulk container of the kind used in storage of materials which container is normally transported from location to location by a fork lift truck and which comprises sidewalls and a base, with a recess or opening in its lower portion below the base, said recess or opening being capable of receiving the "tines" of a fork. Such a bulk container is hereinafter called a "container of the kind set forth".

According to one aspect of the present invention there is provided a container of the kind set forth wherein the recess has a sloping inlet so that the space into which the front ends of the tines can enter the recess is of greater height than the remainder of the recess. Reinforcing means are preferably provided at the sloping inlet. The container is preferably a moulded plastics unit and the reinforcing means are preferably ribs which extend in the direction of the recess.

According to another aspect of the invention there is provided a container of the kind set forth wherein the upper portion of the sidewalls are capable of flexing inwardly in the event that they are engaged by the ends of a tine.

According to a further aspect of the invention there is provided means for repairing a side walls of a container of the kind set forth, the said means comprising a pair of plates one of which has projecting connector pieces thereon and the other of which has receiving openings into which the connector pieces can be received in such a way that the two plates can be secured together to form a robust reinforcing plate. The projecting means are preferably cylindrical stubs the ends of which can be sealed over the openings or may be bonded to the other plate or may be an firm fit in the openings.

An embodiment of the invention will now be described by way of example with reference to the accompanying drawings.

IN THE DRAWINGS

Figure 1:
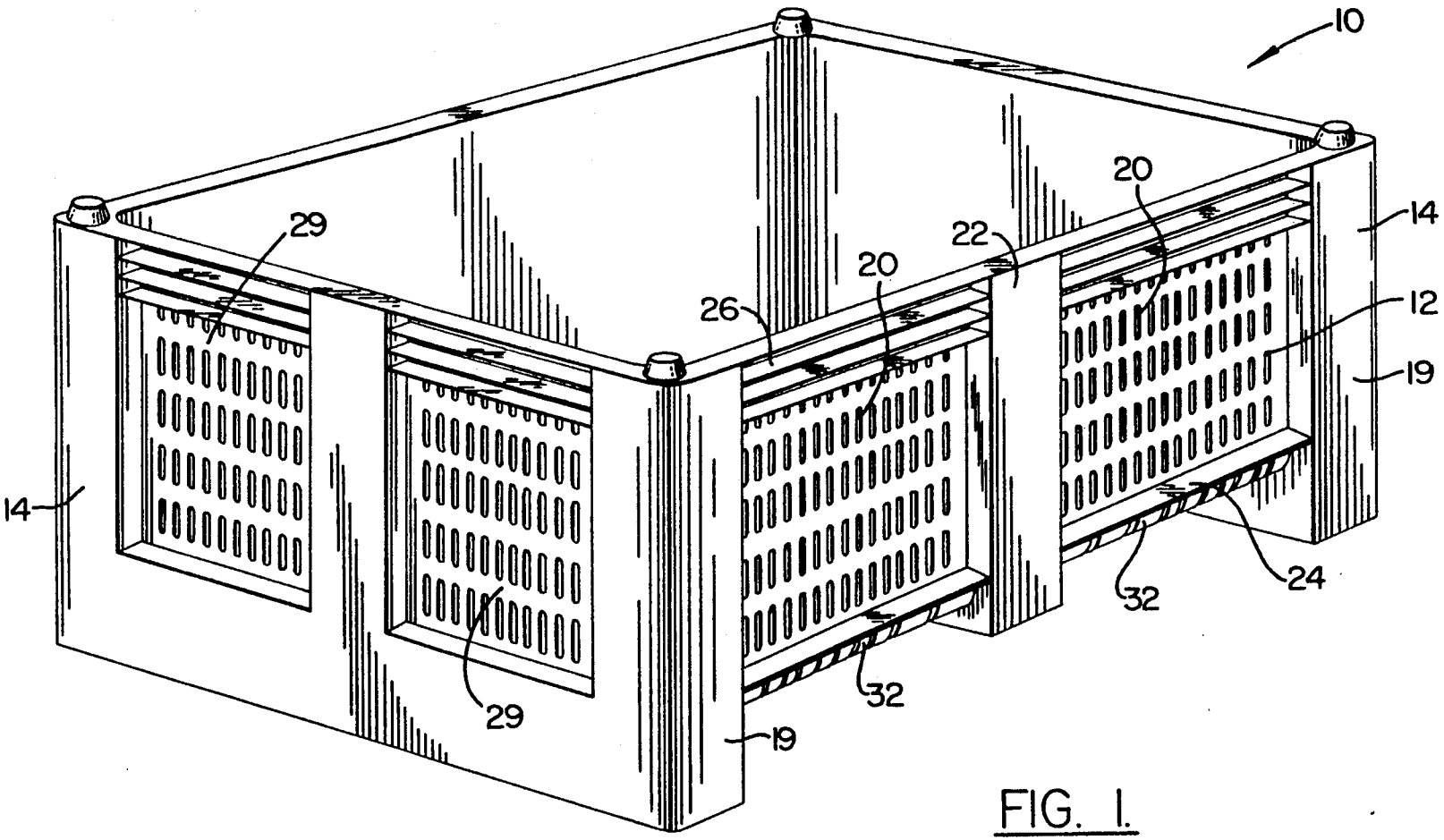
FIG. 1 is a perspective view of a bulk container of the invention.
Figure 3:
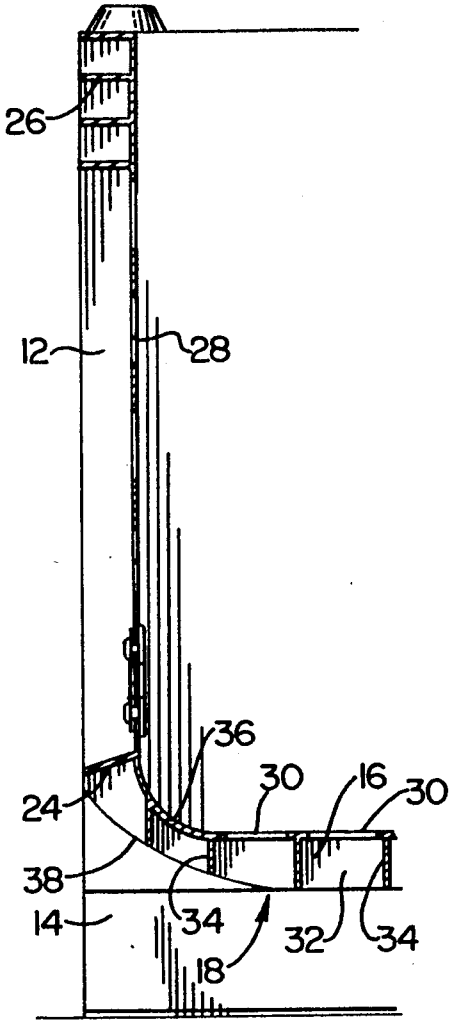
FIG. 3 is a section through the the front of the container.
Figure 2:
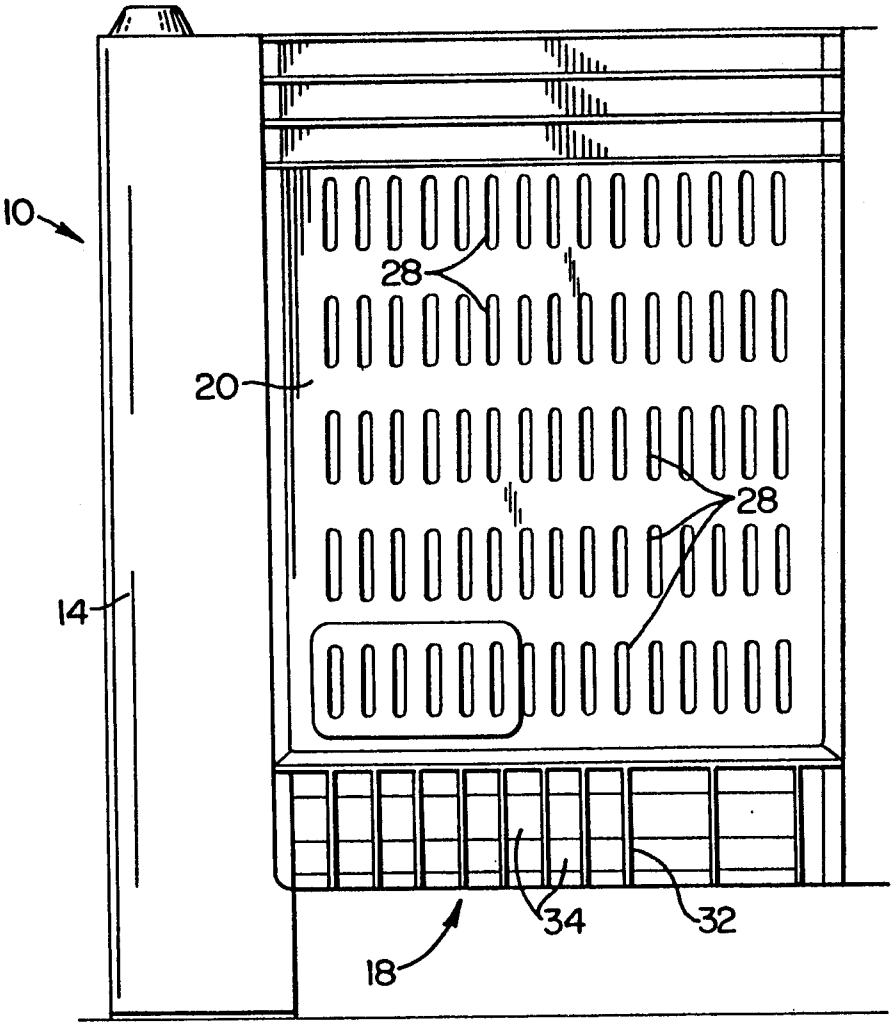
FIG. 2 is a detail front view of the container.

Referring now to the drawings, there is shown a plastics moulded bulk container 10 for use for example by farmers and others who store farm produce. The container 10 comprises front and rear walls 12, side walls 14 and a base 16. The side walls 14 extend beyond the base 16 so that there is an opening or recess 18 below the base 16.

The front and rear walls 12 each comprise a pair of corner members 19 between which are a pair of thin but robust panels 20 extending over virtually the entire height of the associated wall and being separated by a central column 22. Each panel 20 terminates at its lower end in a downwardly sloping flange 24 and having a set of four horizontal flanges 26 at the upper end, the flanges extending between the columns 18 and 22. The panels 20 are provided with rows of vertical slots 28 to permit air flow to the contents of the container.

The side walls 14 are generally similar to the front and rear walls but somewhat less wide. They have have panels 29 that are similar to the panels 20.

It will be noted that there are no re-inforcing means between the flanges 26. Thus the upper portions of the walls will be rather flexible and will be able to accomodate a fair amount of movement should the ends of the tines of a fork lift truck strike them.

The base 16 is also has elongated slots 30 and has longitudinal and transverse vertical reinforcing ribs 32 and 34 formed integrally therewith.

At its ends the base 16 has an enlarged radius 36. The longitudinal ribs 32 run around this radius but are of varying height so as to form a smooth sloping enlarged entrance guide 38 to the recess 18. At its maximum height, the entrance 38 is twice the height of the opening 18, i.e. the height of the lower edges of the longitudinal ribs 32 above the ground (or as will often occur in practice, the height of such ribs above the upper edge of another container on which the container is stacked).

A patch device 40 is shown. This comprises a pair of plates 42 and 44 which have registering slots 46 therein that will register with the slots 28. The plate 42 has openings 48 therein and the plate 44 is provided with hollow cylindrical projections 50 that are spaced to pass through slots 28 and to engage in the openings 48.

Figure 6:
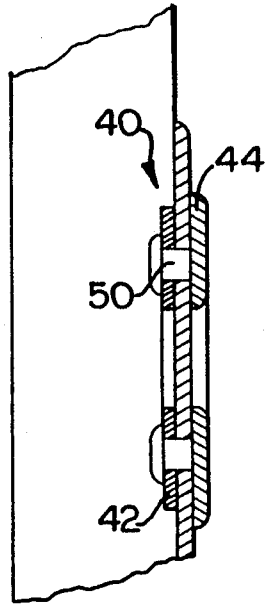
FIG. 6 is an enlarged detail of FIG. 3
Figure 5:
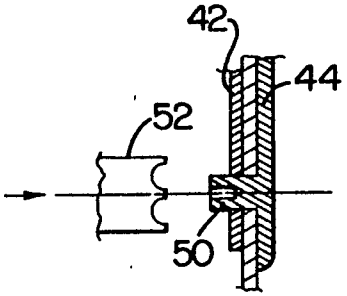
FIG. 5 is a detail showing the formation of the end of the connector piece.
Figure 4:
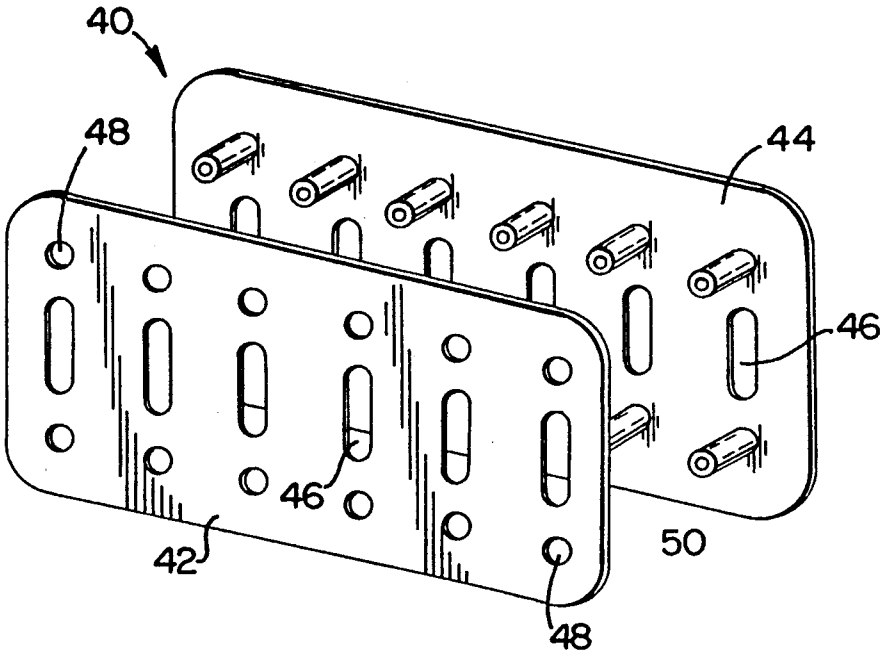
FIG. 4 is a perspective view through a pair of plates forming part of the repairing means.

Should a panel 20 or 29 be punctured by the tines of a fork of a fork lift truck, the puncture can be repaired by placing the plates on either side of the panel with the projections 46 entering the openings 48. A heated member 52, (see FIG. 5) is applied to the ends of the projections 50 to cause them to seal over thereby fixing the patch device 40 to the panel (as best shown in FIG. 6. The container can now work in the normal way.

The invention is not limited to the precise constructional details hereinbefore described and illustrated in the drawings. For example, the projections and openings may be interference fits.

Alternatively these parts can be connected together by a bonding material. The shape of the container may be somewhat different.

I claim:

1. A repair device for a container used in the storage of materials, which container is normally transported from location to location by a fork lift truck, the container including sidewalls having elongated ventilation slots therein, a base and an opening in the lower portion of the container below the base with the opening being capable of receiving the tines of a fork lift truck, said device comprising a pair of separate plates one of which has projecting connector pieces thereon spaced so as to be able to fit through the ventilation slots and the other of which has receiving openings into which said connector pieces can be received and secured to form a robust reinforcing plate; and each of said plates comprising slots adapted and arranged for registration with said ventilation slots of said sidewalls.

2. Repair means as claimed in claim 1 in which said projecting means are cylindrical stubs the ends of which can be sealed over the openings.

3. Repair means as claimed in claim 1 in which said projecting means are cylindrical stubs the ends of which are bonded to the other plate.

4. Repair means as claimed in claim 1 in which said projecting means are cylindrical stubs which are a firm fit in said receiving openings.

5. A repair device as claimed in claim 2 in which said cylindrical stubs are hollow stubs.

6. A bulk container as claimed in claim 5 wherein said first plate has a pair of connector pieces located at opposite ends of said ventilation openings in said first plate.

7. A repair device as claimed in claim 1 in which said plates are substantially smaller than said sidewalls.

8. A bulk container used in storage of materials and which container is normally transported from location to location by a fork lift truck, the container comprising sidewalls having ventilation openings therein, a base, and repair means including a pair of plates, one of said plates having projecting connector pieces thereon which pass through ventilation openings and the other of said plates having receiving openings into which the connector pieces can be securely received to form a robust reinforcing plate, said plates additionally comprising slots adapted and arranged for registration with said ventilation openings of said container said repair means being applied to one of said sidewalls with one of the plates being provided on one side of said sidewall and the other plate on the other side of said sidewall and said slots being in registration with said ventilation opening.

9. A bulk container as claimed in claim 8 in which each plate has ventilation openings therein that register with the ventilation openings in the part of the punctured sidewall covered by said plates.

10. A bulk container as claimed in claim 8 in which said plates are substantially smaller than said sidewalls.

11. A method of repairing a bulk container comprising sidewalls having ventilation slots therein, one of which sidewalls has a puncture opening therein, said method comprising:

laying on one side of the punctured sidewall, a first plate having connector pieces thereon and slots adapted and arranged for registration with said ventilation slots in such a way (a) that said first plate covers said puncture opening, (b) that said connector pieces pass through said sidewall, and (c) that said slots in said plate are in registration with said ventilation slots, laying on the other side of said punctured sidewall, a second plate having slots adapted and arranged for registration with said ventilation slots in a position corresponding to the position of said first plate, and bonding said connector pieces to said second plate.

12. A method as claimed in claim 11 in which said second plate has receiving openings therein at positions corresponding to the location of said connector pieces, said receiving openings receiving said connector pieces and being bonded thereto.

13. A method as claimed in claim 12 comprising passing the ends of said connector pieces through said receiving openings and heating said ends to seal them over thereby fixing said plates together.

14. A method of repairing a bulk container used in storage of materials and which container is normally transported from location to location by a fork lift truck, the container comprising sidewalls having ventilation openings therein, one of which sidewalls has a puncture opening therein, sand method comprising:

laying on one side of the punctured sidewall, a first plate having connector pieces thereon and slots adapted and arranged for registration with said ventilation openings in such a way (a) that said first plate covers said puncture opening (b) that said connector pieces pass through the ventilation openings, and (c) that said slots in said plate are in registration with said ventilation openings, laying on the other side of said punctured sidewall, a second plate having slots adapted and arranged for registration with said ventilation openings in a position corresponding to the position of said first plate, and bonding said connector pieces to said second plate.

* * * * *

UNITED STATES PATENT AND TRADEMARK OFFICE

CERTIFICATE OF CORRECTION

PATENT NO. : 5,183,178

DATED : February 2, 1993

INVENTOR(S) : Flemming

It is certified that error appears in the above-identified patent and that said Letters Patent is hereby corrected as shown below:

On the cover page, Item No. [76], the inventor's name "Elvin-Jensen Flemming" is incorrect, it should read -- Flemming Elvin-Jensen --.

Item [19] should read --Elvin-Jensen--

Signed and Sealed this

Fourteenth Day of June, 1994

Bruce Lehman

*Attest:*

BRUCE LEHMAN

*Attesting Officer*

*Commissioner of Patents and Trademarks*